United States Patent [19]

Dubreux et al.

[11] Patent Number: 4,784,787

[45] Date of Patent: Nov. 15, 1988

[54] METHOD AND COMPOSITION FOR BLEACHING LAUNDRY

[75] Inventors: Bernard Dubreux, Francheville Le Bas; Francoise Chosson, Millery, both of France

[73] Assignee: Atochem, France

[21] Appl. No.: 49,128

[22] Filed: May 12, 1987

[30] Foreign Application Priority Data

May 15, 1986 [FR] France ..... 86 07151

[51] Int. Cl.[4] ..... C11D 7/54

[52] U.S. Cl. ..... 252/95; 252/186.43; 252/103; 252/99

[58] Field of Search ..... 252/186.43, 103, 99, 252/95

[56] References Cited

U.S. PATENT DOCUMENTS

| | | | |
|---|---|---|---|
| 3,230,171 | 1/1966 | Moyer | 252/95 |
| 3,950,126 | 4/1976 | Sugano | 8/111 |
| 4,120,650 | 10/1978 | Kappler | 8/109 |

*Primary Examiner*—John F. Niebling
*Assistant Examiner*—Isabelle Rodriquez
*Attorney, Agent, or Firm*—Sigalos, Levine & Montgomery

[57] ABSTRACT

Bleaching laundry in a bath using a peroxidized compound characterized in that bleaching is carred out at a pH of between 10.5 and 12.5 in the presence of calcium peroxide ($CaO_2$) as the peroxidized compound, introduced in the hydrated or the anhydrous form so that the quantity of calcium per liter of bath is between $1\times10^{-3}$ and $1\times10^{-2}$ gram-atom.

12 Claims, No Drawings

METHOD AND COMPOSITION FOR BLEACHING LAUNDRY

BACKGROUND OF THE INVENTION

The present invention relates to the bleaching of laundry using a peroxidized compound.

Hydrogen peroxide, persalts or peroxyhydrates such as, in particular, sodium perborate have been used for a long time in the field of this invention.

However, these compounds have the disadvantage of not being sufficiently effective at a temperature of less than approximately 70° C. It then becomes necessary to add to them an activator such as, for example, tetraacetylethylenediamine (TAED), tetraacetylglycoluryl (TAGU) or α-acetoxy-α-methyl-N,N'-diacetylmalonamide (AP 31) described in the French patent published under the No. 2,363,541.

Such activators; the synthesis and the form of production of which are expensive, are a heavy burden on the profitability of bleaching.

Moreover, sodium perborate, which is by far the most used peroxidized bleaching agent hitherto, is well known to be at the origin of pollution caused by the presence of boron in the waste waters.

The substitution of hydrogen peroxide or of persalts with organic hydroperoxides, or more precisely, because of the low solubility of the latter, some of their soluble derivatives, has been proposed in U.S. Pat. No. 3,746,646.

French patent application published under No. 2,552,123, for its part, proposes the use of aminoperoxides the synthesis of which, described especially in the article by E. G. E. HAWKINS, J. Chem. Soc., (1969), 191, pp. 2678–2681, remains difficult and expensive.

SUMMARY OF THE INVENTION

The method according to the invention and the compositions used for implementing it which form another subject of the invention lead to better bleaching effects than those obtained with peroxidized compounds used hitherto, while avoiding the pollution caused by the most widely used among them, sodium perborate, and the use of complex activators.

Briefly, the invention comprises bleaching laundry in a bath using a peroxidized compound characterized in that bleaching is carried out at a pH of between 10.5 and 12.5 in the presence of calcium peroxide ($CaO_2$) as the peroxidized compound, introduced in the hydrated or the anhydrous form so that the quantity of calcium per liter of bath is between $1\times10^{-3}$ and $1\times10^{-2}$ gram-atom.

DETAILED DESCRIPTION

The most useful results, from an economic point of view or from the point of view of reliability of the method, are obtained at a bath temperature preferably between approximately 30° C. and 70° C., at a pH limited to not more than 11.5, these two parameters being considered alone or together.

Below 30° C., the improvement observed in the bleaching effect, although still substantial at 20° C., nevertheless decreases. Above 70° C., the amount of energy consumed negates the industrial value of the method.

Beyond a pH of approximately 11.5, the risk of cellulose fiber degradation may become not insignificant.

The bath may also contain; as is most frequently the case in practice, in type or in quantity, all or some of the products which are known to be usually present in a bath with detergent action, other than peroxidized bleaching agents, and such as the surfactants and builders: alkylbenzenesulphonates, alkylarylbenzenesulphonates, ethoxylated fatty alcohols; anti-resettling agents; blueing agents; perfumes, sequestering agents; alkali phosphates; and the like. Known detergents are given, for example, in DETERGENT MANUFACTURE by Marshall Sittig, Noyes Data Corporation, 1976.

The sequestrants for alkaline earth metal ions, the presence of which in the bath is optional; but nevertheless preferred, are selected, for example, from the alkali metal salts of polyphosphoric acids such as sodium tripolyphosphate; hereinafter called NaTPP; alkali metal salts of polyaminecarboxylic acids or polyoxycarboxylic acids such as those of ethylenediaminetetraacetic acid; pentasodium salt of diethylaminetriaminepentaacetic acid, trisodium salt of nitrilotriacetic acid; or sodium citrate.

NaTPP is well suited within the scope of the invention.

The bleaching effect is particularly improved by the application of the method of the invention when the complexing agent for alkaline earth metal ions is employed in a quantity at least equal to that which enables the sequestration of calcium ions in solution in the bath to occur.

A composition according to the invention, containing a peroxidized compound for bleaching laundry is characterized in that it contains, as the peroxidized compound, calcium peroxide ($CaO_2$) in the hydrated or the anhydrous form, in a quantity which permits the preparation of a bath which contains, at a pH of between 10.5 and 12.5, $1\times10^{-3}$ to $1\times10^{-2}$ gram-atom of calcium per liter with a view to implementing the method described above.

Such a composition may also contain in type and in quantity all or some of the products known to be usually present in a bath with detergent action, such as those mentioned above; other than the peroxidized bleaching compounds hitherto used.

Thus, it may contain sequestrants for alkaline earth metal ions, preferably in a quantity at least equal to that corresponding to the sequestration of calcium ions in solution tion in the bath prepared from it. Sodium tripolyphosphate is well suited, in particular, in a composition according to the invention, as the sequestrant for calcium ions.

A composition of the present invention makes it possible to prepare the bleaching bath by simultaneously adding all its constituents to the bath.

The preparation of the bath may be carried out in any way, bringing its constituents into contact in any sequence. For example, calcium peroxide in the hydrated or the anhydrous form may be added to the other constituents, including the sequestrant where appropriate, solubilized in water prior to this addition.

The calcium peroxide used in the hydrated or the anhydrous form in implementing the method or preparing the composition of the invention may be prepared in any known way. Examples for the preparation are given, for example, in NOUVEAU TRAITE DE CHIMIE MINERALE (New Treatise On Inorganic Chemistry) by P. Pascal, volume IV, 1958, pp. 399–400 or in PEROXIDES, SUPEROXIDES AND OZONIDES OF ALKALI AND ALKALINE EARTH METALS by Il'ya Ivanovich Vol'nov, Plenum Press, New York 1966, pp. 58–60.

It is particularly advantageous to use a form of calcium peroxide which has the highest solubility under the conditions of implementing the method of the invention.

The bleaching operation according to the invention is followed by operations of rinsing and spin-drying before drying, as in the case of conventional methods.

The invention will be further described in connection with the following examples which are set forth for purposes of illustration only.

In these twelve examples:

(i) the term "washing powder" is used to denote an EMPA ® standardized washing powder containing, by weight, 14% of surfactants, 30.4% of sodium tripolyphosphate, the remaining amount required to make up 100% comprising sodium pyrophosphate, sodium orthophosphate and other sodium salts, as well as blueing agents, miscellaneous compounds and 18.9% of water, (ii) the method of the invention is carried out in a stirred cylindrical tank made of glass, equipped with a heating means and containing the bath and an EMPA ® standardized fabric, which is stained with wine, in a bath/fabric weight ratio of 100. Such a high ratio was chosen only for reasons of convenience. It is a parameter which has no practical consequence on the result obtained with the method.

(iii) the washing-bleaching operation comprises a temperature plateau of 15 minutes. Only the value of this temperature will hereinafter be mentioned. The rate of increase of bath temperature from an ambient temperature of approximately 20° C. up to the plateau temperature is 10° C. per minute. At the end of the operation, the treated fabric is separated from the bath in the conventional way, drained and rinsed with water at ambient temperature before drying, (iv) each time, the pH of the bath is between 10.5 and 12.5, (v) the degree of whiteness of the fabric is determined using an ERICHSEN GLOSSMASTER No. 507 spectrophotometer calibrated, using the magnesium oxide supplied as standard with the apparatus, to give a degree of whiteness of 90, (vi) the fabric to be treated has a measured degree of whiteness of 41, and (vii) the calcium peroxide was used in the form of octahydrate.

The characteristics of the twelve examples and the results obtained for each of them are collated in Table I below.

TABLE I

| Example No. | Bath Temperature °C. | Concentration in the bath: Calcium gram-atoms/l | Washing powder g/l | Sodium citrate mol/l | Sodium perborate mol/l | Degree of whiteness |
|---|---|---|---|---|---|---|
| 1 | 30 | $5 \times 10^{-3}$ | 11.3 | | | 65 |
| 2 | 40 | $1 \times 10^{-2}$ | 11.3 | | | 71 |
| 3 (Comp.) | 40 | | 11.3 | | $1 \times 10^{-2}$ | 62 |
| 4 | 60 | $1 \times 10^{-2}$ | 11.3 | | | 82.5 |
| 5 | 60 | $1 \times 10^{-2}$ | 9 | | | 81 |
| 6 (Comp.) | 60 | | 9 | | $1 \times 10^{-2}$ | 72 |
| 7 (Comp.) | 60 | | | | $1 \times 10^{-2}$ | 68 |
| 8 | 60 | $1 \times 10^{-2}$ | | | | 78.5 |
| 9 | 60 | $2 \times 5.10^{-3}$ | | | | 72 |
| 10 | 60 | $5 \times 10^{-3}$ | 6.8 | | | 77 |
| 11 (Comp.) | 60 | | 6.8 | | $5 \times 10^{-3}$ | 66 |
| 12 | 60 | $1 \times 10^{-2}$ | | $1 \times 10^{-2}$ | | 80 |

Examples 3, 6, 7 and 11 are given by way of comparison.

From a comparison of Example 2 with 3, 5 with 6, 8 with 7, and 10 with 11, respectively, it is revealed that the invention enables the degree of whiteness to be increased by more than 15% on average.

From a comparison of Example 9 with 7, it is revealed that by using, according to this invention, a quantity of peroxidized agent, expressed as active oxygen, which is 4 times lower than in a known method, it is possible to achieve a degree of whiteness at least as high as that obtained with the latter.

From a comparison of Example 1 with 11, it is possible to conclude that the same degree of whiteness may be expected from a method which does not incorporate the invention or which incorporates the invention but in this latter case at a temperature which is 20° C. to 30° C. lower.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A method for bleaching laundry in a bath in the absence of any peroxide activator consisting essentially of introducing into said bath as the only bleaching agent a peroxidized compound and carrying out said bleaching at a pH of between 10.5 and 12.5 and at a temperature between about 30° and 60° C.; said peroxidized compound being a calcium peroxide in the hydrated or the anhydrous form and introduced so that the quantity of calcium per liter of bath is between $1 \times 10^{-3}$ and $1 \times 10^{-2}$ gram atom.

2. The method of claim 1, wherein the pH of the bath is not more than 11.5.

3. The method of claim 2, wherein the bath contains a sequestrant for alkaline earth metal ions.

4. The method of claim 3, wherein the sequestrant for alkaline earth metal ions is in a quantity at least equal to that required for the sequestration of calcium ions in solution in the bath.

5. The method of claim 4, wherein the sequestrant for alkaline earth metal ions is sodium tripolyphosphate.

6. The method of any one of claims 1 to 5, wherein calcium is employed in the form of a compound which corresponds to the formula $CaO_2 \cdot 8H_2O$.

7. The method of any one of claims 1 to 5, wherein the bath contains a detergent and the calcium is employed in the form of a compound which corresponds to the formula $CaO_2 \cdot 8H_2O$.

8. A composition consisting essentially of a detergent and a calcium peroxide in the hydrated or the anhydrous form in a quantity which permits the preparation of a bath which contains, at a pH of between 10.5 and 12.5, $1 \times 10^{-3}$ to $1 \times 10^{-2}$ gram-atom of calcium per liter.

9. The composition of claim 8, wherein the calcium is employed in the form of a compound which corresponds to the formula $CaO_2 \cdot 8H_2O$.

10. The composition of claim 9 also containing a sequestrant for alkaline earth metal ions.

11. The composition of claim 10, wherein the sequestrant for alkaline earth metal ions is in a quantity at least equal to that required for the sequestration of the calcium ions in solution in the bath prepared using the said composition.

12. The composition of claim 11, wherein the sequestrant is sodium tripolyphosphate.

* * * * *